US007941894B1

(12) United States Patent
Skorput

(10) Patent No.: US 7,941,894 B1
(45) Date of Patent: May 17, 2011

(54) GOLF COURSE GREEN DEBRIS REMOVAL DEVICE

(76) Inventor: Tony Skorput, Marion, SC (US)

( * ) Notice: Subject to any disclaimer, the term of this patent is extended or adjusted under 35 U.S.C. 154(b) by 0 days.

(21) Appl. No.: 12/700,847

(22) Filed: Feb. 5, 2010

(51) Int. Cl.
*A47L 5/24* (2006.01)

(52) U.S. Cl. ..... 15/344; 15/405; 15/419

(58) Field of Classification Search ..... 15/344, 15/405, 410, 413, 419, 320; 415/210.1; 417/411, 417/423.2, 234, 315
See application file for complete search history.

(56) References Cited

U.S. PATENT DOCUMENTS 4,175,352 A * 11/1979 Catlett ..... 43/139
4,288,886 A * 9/1981 Siegler ..... 15/330
4,734,017 A * 3/1988 Levin ..... 417/366
4,945,604 A * 8/1990 Miner et al. ..... 15/344
5,839,204 A * 11/1998 Cinque et al. ..... 34/97
5,938,410 A * 8/1999 Lee ..... 417/234
2005/0210624 A1* 9/2005 Lammers et al. ..... 15/344
2009/0038108 A1* 2/2009 Shaanan et al. ..... 15/344

* cited by examiner

*Primary Examiner* — Dung Van Nguyen

(57) ABSTRACT

A golf course green cleaning device configured to remove debris from the predicted putting path of a golf ball. The golf course green cleaning device further includes a housing having three contiguous portions. The first portion is generally cylindrical in shape and has disposed therein a rechargeable power supply. The second portion is spherical in shape and is substantially hollow. The second portion has a fan an motor assembly therein configured to generate an airflow. The third portion is operably coupled to the second portion and is cylindrical in shape having an internal air passage to receive the airflow from the second portion. Removably attached to the third portion distal from the second portion is a nozzle that directs the airflow exiting the third portion so as to remove debris from the predicted putting path of a golf ball.

3 Claims, 2 Drawing Sheets

GOLF COURSE GREEN DEBRIS REMOVAL DEVICE

FIELD OF THE INVENTION

The present invention relates to a golf course cleaning device designed to remove debris from an area on a golf course, more specifically but not by way of limitation, the golf course green cleaning device is configured to substantially remove the debris present within the predicted putting path of a golf ball.

BACKGROUND

Millions of individuals engage in the game of golf either as a recreational sport or at a competitive level. Many of those that play the game of golf regularly spend a significant amount of time and money on lessons and devices that are designed to improve the ability and/or score of the player. An avid golfer will invest time and resources specifically to address areas of the game or their swing to improve their ability in that particular area.

One element of the game of golf in which golfers invest a lot of resources is putting. Putting can be one of the most challenging tasks for a golfer. Every stroke saved on the green is crucial to achieving a desirable score. Many golfers invest substantial resources in purchasing lesson specifically focused on putting. Additionally, those golfers will invest hundreds of dollars for a putter that they feel will help them perform better during a game of golf. As is known in the art, golfers will face numerous challenges once the golf ball is in position on the green. Many greens have undulated surfaces that require careful consideration of the putting direction before putting the ball. As greens on golf courses are routinely lined with trees and other landscaping many times the surface of the golf course green can be littered with debris such as but not limited to leaves or twigs.

One problem with the element of putting is that the golfer must contend with and attempt to remove the debris that may be in the predicted putting path of the golf ball. Typically a golfer will attempt to remove as much of the debris as possible in order to eliminate the chance of any debris contacting the golf ball once it has been putted in a given direction. The most common method of removal involves the golfer surveying the predicted putting path and manually removing the leaves or other debris by bending down and retrieving the debris. This method is usually time consuming and can also be problematic for golfers who suffer from back problems.

Accordingly, there is a need for a device that can facilitate the removal of debris from a golf course green more specifically in the predicted putting path of a golf ball that does not require the golfer to bend over and can be performed in a timely manner.

SUMMARY OF THE INVENTION

It is the object of the present invention to provide a device that can quickly remove debris from a golf course green more specifically in the area of the predicted putting path of a golf ball.

Another object of the present invention is to provide a device that can remove debris from a predicted putting path of a golf ball on a golf course green that utilizes forced air to facilitate the removal of the debris.

Yet a further object of the present invention is to provide a device that can remove debris from a predicted putting path of a golf ball on a golf course green utilizing forced air that is ergonomic for the user.

Still another object of the present invention is to provide a device that can remove debris from a predicted putting path of a golf ball on a golf course green utilizing forced air that further includes a rechargeable power source.

An additional object of the present invention is to provide a device that can remove debris from a predicted putting path of a golf ball on a golf course green that further includes a charging station that is operably coupled to a golf cart.

Another object of the present invention is to provide a device that can remove debris from a predicted putting path of a golf ball on a golf course green that includes a telescoping portion able to be placed proximate the surface of the golf course green.

Still a further object of the present invention is to provide a device that can remove debris from a predicted putting path of a golf ball on a golf course green that is lightweight and easy to use.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1A:
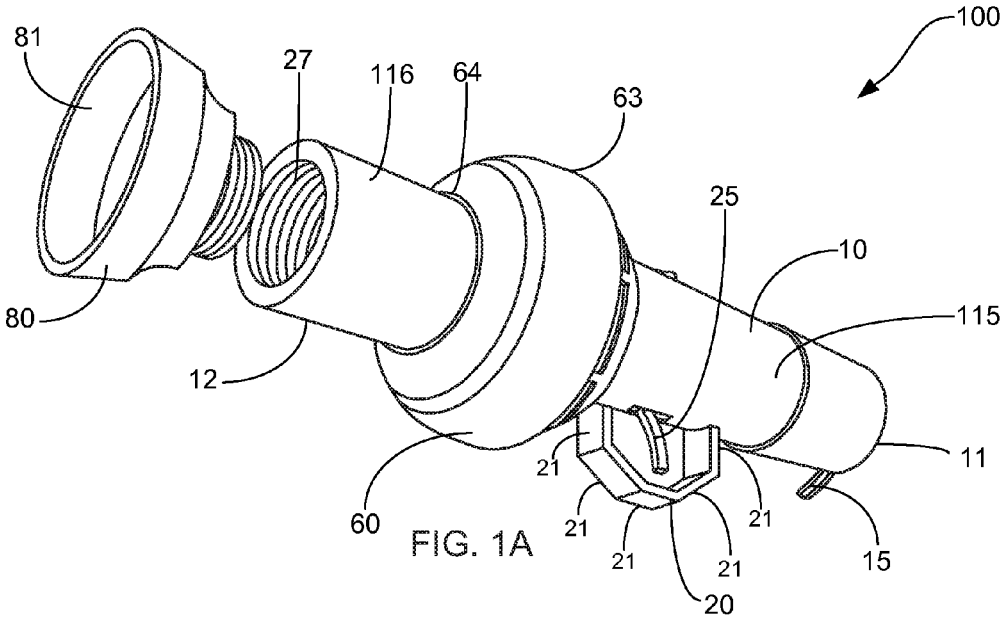
FIG. 1A is a perspective view of an embodiment of the present invention showing an embodiment of the nozzle detached therefrom.

Referring now to the drawings submitted herewith, wherein various elements depicted therein are not necessarily drawn to scale and wherein throughout the views and figures like elements are referenced with identical reference numerals, there is illustrated a golf course green cleaning device 100 constructed according to the principles of the present invention.

Figure 1B:
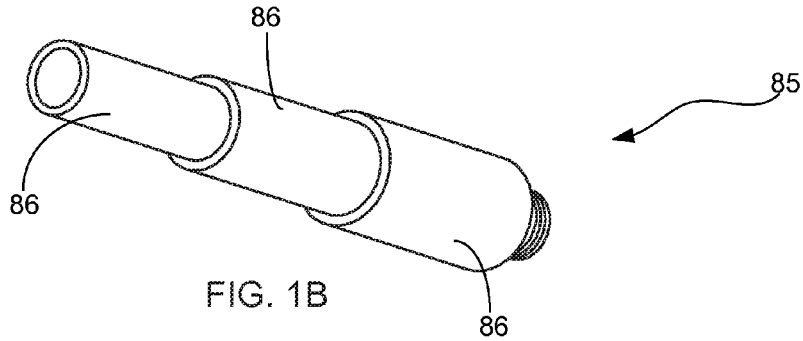
FIG. 1B is a perspective view of an alternative embodiment of a nozzle.
Figure 2:
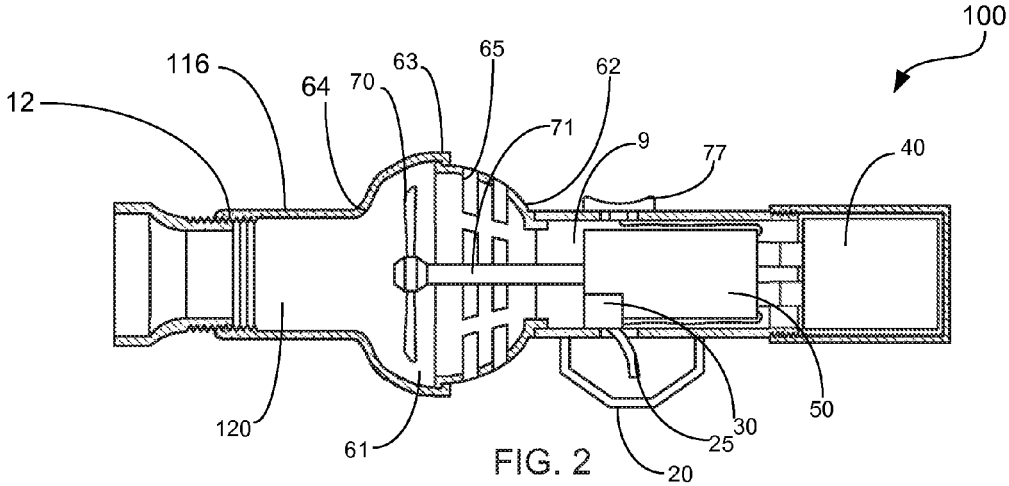
FIG. 2 is a diagrammatic view of the embodiment of the present invention.
Figure 3:
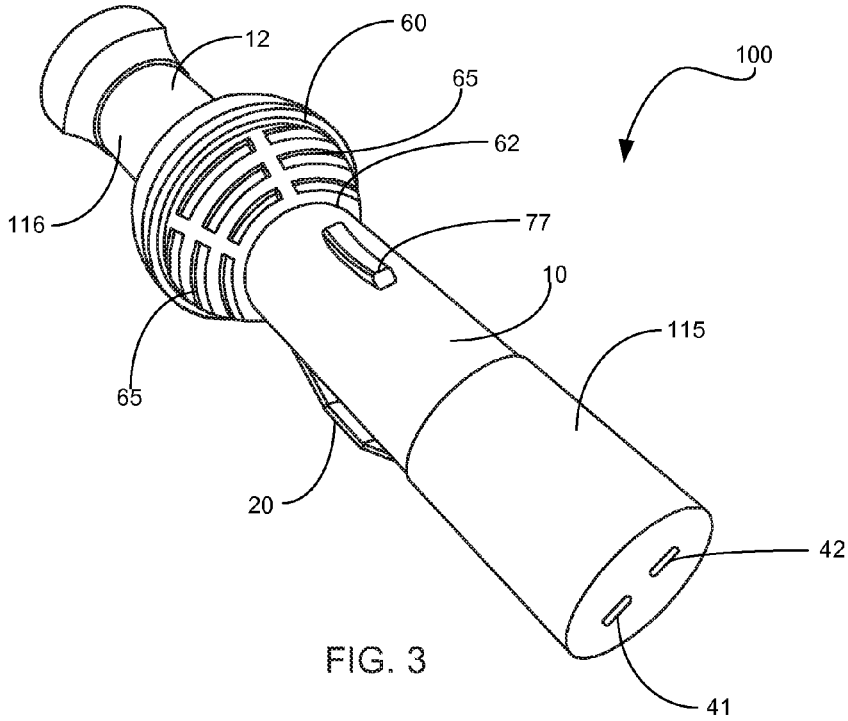
FIG. 3 is a rear perspective view the embodiment of the present invention.

Referring in particular to FIGS. 1, 2 and 3 there is illustrated a golf course green cleaning device 100 that further includes a body 10 that is generally cylindrical and elongated in shape having an internal volume 9 sufficient in size to house internal components required for the operation of the golf course green cleaning device 100. The body 10 further includes a first portion 115, a second portion 60 and a third portion 116. The first portion 115, second portion 60 and third portion 116 are contiguously formed with each other and have an internal volume 9. The body 10 is manufactured from a suitable durable material such as but not limited to plastic. The body 10 has a first end 11 and a second end 12. The body 10 functions to house the internal components of the golf course green cleaning device 100 in a substantially weatherproof manner. While no particular length of the body 10 is required good results have been achieved utilizing a body 10 that is approximately eighteen inches in length. Those skilled in the art should recognize that the body 10 could be manufactured in numerous different shapes, sizes and colors and still perform the desired function as described herein.

Movably secured proximate the first end 11 of the body 10 is an keeper 15. The keeper 15 is manufactured in a modified annular shape. The keeper 15 is manufactured from a suitable durable material such as but not limited to metal. The keeper 15 functions to allow a user to releasably secure the golf course green cleaning device 100 to a conventional d-ring or other similar device located on a golf bag.

Integrally mounted to the body 10 is a trigger guard 20. The trigger guard 20 is manufactured from a suitable durable material such as but not limited to plastic. The trigger guard 20 further comprises five portions 21 that are contiguous with each other and angularly joined to create the shape of the trigger guard 20. While in the preferred embodiment illustrated herein the trigger guard 20 comprises five portions 21 that are angularly joined with each other, it is contemplated within the scope of the present invention that the trigger guard 20 could be manufactured from as few as a single portion to create a semi-annular shape and still perform the desired function as described herein. The trigger guard 20 functions to protect the trigger 25 in the event that the golf course green cleaning device 100 is dropped or mishandled.

The trigger 25 is movably mounted to the body 10 and disposed within the trigger guard 20. The trigger 25 is generally arcuate in shape and is manufactured from a suitable durable material such as but not limited to plastic. The trigger 25 is the user interface for the momentary contact switch 30 disposed within the internal volume 9 of the body 10. The user applies a force on the trigger 25 in a direction towards the first end 11 of the body 10 in order to engage the momentary contact switch 30. As is known in the art, a momentary contact switch 30 closes an electrical circuit allowing current to flow therethrough only while the momentary contact switch 30 is engaged. The momentary contact switch 30 disposed within the internal volume 9 of the body 10 is configured as what is known in the art as a normally open switch. When the trigger 25 is in its first position the momentary contact switch 30 is in an open position so as to inhibit current from flowing through the circuit. When the user moves the trigger 25 to its second position the momentary contact switch 30 is now in a closed position which allows current to flow through the circuit. The momentary contact switch 30 is electrically coupled to the power source 40 and the fan motor 50. The momentary contact switch 30 is electrically intermediate the power source 40 and fan motor 50 so as to control the current flow from the power source 40 to the fan motor 50.

Opposite the trigger 25 on the first portion 115 of body 10 is a power switch 77. The power switch 77 is operably coupled to the power source 40 and functions to allow current to flow from the power source 77. The power switch 77 is a conventional switch having a first and second position wherein in its first position the power switch 77 is open and current can not exit the power source 40. In its second position, the power switch 77 is closed so as to electrically couple the power source 40 with the momentary contact switch 30. In this position the momentary contact switch 30 is activated by the trigger 25 and current will flow to the fan motor 50 thereby rotating the fan 70.

The power source 40 is disposed within the internal volume 9 of the first portion 115 of the body 10 proximate the first end 11. The power source 40 is a conventional rechargeable power source such as but not limited to a lithium ion battery. Those skilled in the art should recognize that numerous different types of batteries could be utilized to manufacture the power source 40. The power source 40 functions to provide current to the fan motor 50 during operation of the golf course green cleaning device 100. The power source 40 includes a first contact 41 and a second contact 42 that are mounted on the exterior surface 8 of the body 10 proximate the first end 11. The first contact 41 and second contact 42 are conventional battery contacts that function to electrically engage with the contacts disposed within the charger 90 so as to receive current therefrom in order to recharge the power source 40.

Integrally formed with the first portion 115 of the body 10 is the second portion 60. The second portion 60 is generally spherical in shape and generally hollow having a cavity 61 therein that is sufficient in size to accommodate the fan 70. The fan 70 disposed within the second portion 60 is a conventional electric fan coupled to the fan motor 50 with a shaft 71. The fan motor 50 functions to rotate the fan 70 in order to produce an airflow that will exit the third portion 116 of the body 10 proximate the second end 12. The second portion 60 includes a first segment 62 that has approximately the same diameter as the first portion 115 of the body 10 proximate thereto. The diameter of the second portion 60 gradually increases towards the midpoint 63 of the second portion 60 whereupon the diameter of the second portion 60 begins to reduce until it reaches the second segment 64 wherein the diameter of the second portion 60 proximate the second segment 64 is equivalent to the diameter of the third portion 116 of the body 10. The shape of the second portion 60 functions to direct the airflow generated by the fan 70 so as to maximize the velocity of the air as it exits the third portion 116 of the body 10 proximate the second end 12.

Located on the second portion 60 between the first segment 62 and the midpoint 63 are a plurality of intake vents 65. The intake vents 65 function to permit air to enter the second portion 60 as it is drawn in by the rotating fan 70 subsequent the fan motor 50 being activated by the momentary contact switch 30 operably coupled to the trigger 25. Those skilled in the art will recognize that the intake vents 65 could be present in numerous different quantities as well as sizes and shapes and still perform the desired function as described herein.

Forward of the second portion 60 is the third portion 116 of the body 10. The third portion 116 is generally cylindrical in shape and hollow. The internal passage 120 of the third portion 116 receives the airflow from second portion 60 and permits the airflow to move towards the second end 12. Proximate the second end 12 circumferentially disposed around the interior of the body 10 are a plurality of threads 27. The threads 27 function to releasably secure the nozzle 80 to the body 10. Those skilled in the art will recognize that numerous different types of fasteners could be utilized to releasably secure the nozzle 80 to the body 10.

The nozzle 80 is generally funnel shaped and manufactured from a suitable durable material such as but not limited to plastic. The nozzle 80 has an interior surface 81 that is generally angular in position. The angularly shaped interior surface 81 of the nozzle 80 functions to disperse the air exiting the golf course green cleaning device 100 at a wider angle of discharge so as to effectively remove debris from a larger swath. A second nozzle 85 is illustrated herein in FIG. 1A. The second nozzle 85 comprises three portions 86 that are telescoping. The outer portion 87 is smallest in diameter and has a diameter that is less than that of the diameter of the third portion 116 of the body 10. The smaller diameter of the outer portion 87 allows a user to apply a greater force of air exiting the golf course green cleaning device 100 to a smaller area, which can be used to remove debris having more mass. While no particular length of the second nozzle 85 is required good results have been achieved utilizing a second nozzle 85 approximately two feet in length. Additionally, those skilled in the art will recognize that the second nozzle 85 could be manufactured from a single tapered segment. Those skilled in the art will recognize that the nozzle 80 and second nozzle 85 could be formed in numerous different shapes and sizes and still perform the desired function as described herein.

Figure 4:
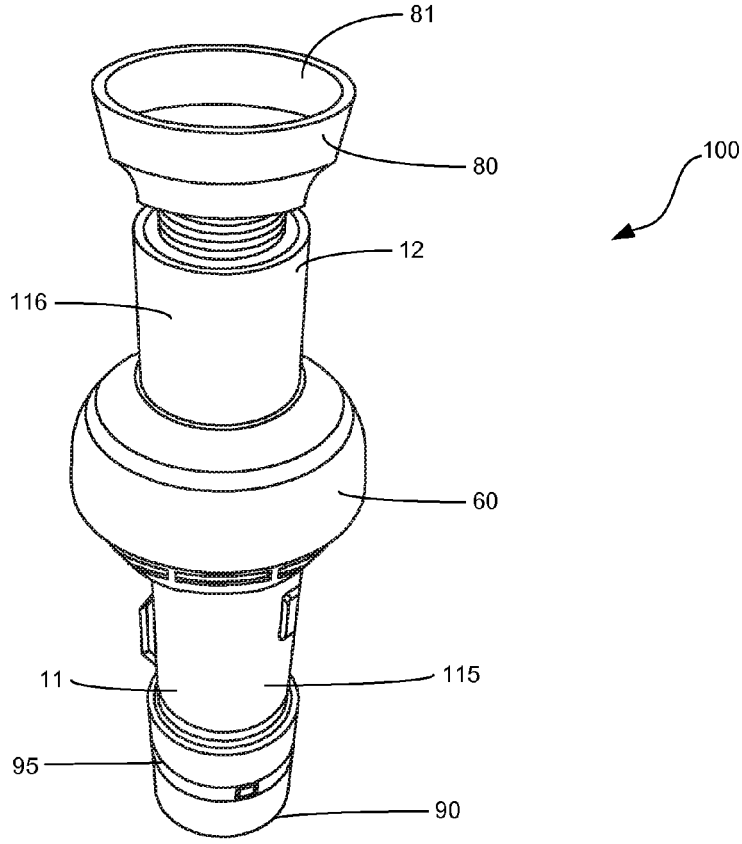
FIG. 4 is a perspective view of the embodiment of the present invention in a vertical orientation engaged with a charging device.

Referring in particular to FIGS. 3 and 4, the golf course green cleaning device 100 is illustrated operably coupled to a charger 90. The charger 90 is manufactured from a suitable durable material such as but not limited to plastic. The charger 90 is formed to mateably connect with the first end 11 of the body 10 so that the first contact 41 and second contact 42 electrically coupled with conventional electrical contacts (not illustrated herein) that are disposed within the charger 90. The charger 90 is operably coupled to a power supply so as to recharge the power source 40 disposed within the body 10. It is contemplated within the scope of the present invention that the charger 90 is operably couplable to both a DC and an AC power source. The charger 90 further includes a strap 95 that is circumferentially disposed around the charger 90. The strap 95 is a conventional adjustable nylon strap that functions to releasably secure the charger 90 to a desired location such as but not limited to a portion of a golf cart. Those skilled in the art will recognize that numerous different types of fasteners could be utilized in place of and/or in conjunction with the strap 95.

Referring in particular to FIGS. 1 and 4, a description of the operation of the golf course green cleaning device is as follows. In use, the user will place the golf course green cleaning device 100 in the charger 90. The charger 90 is then operably coupled to an acceptable AC or DC power source and the golf course green cleaning device 100 is coupled to the charger 90 for a sufficient period of time so as to charge the power source 40. Once the golf course green cleaning device 100 has been charged the user can then releasably secure to their golf bag utilizing the keeper 15. During a round of golf while putting, the user will predict the putting path of their golf ball on the putting greens. Subsequent to the user identifying debris within the predicted putting path of their golf ball that could have an adverse effect of the travel of the golf ball, the user will release the golf course cleaning device 100 from the golf bag and place the nozzle 80 adjacent to the identified debris. The user moves the power switch 77 to its second position and then engages the trigger 25 operably coupled to the momentary contact switch 30. The fan motor 50 spins the fan 70 and air exits the nozzle 80, which displaces the debris from the predicted putting path of the golf ball. Once the user has removed the identified debris to their satisfaction, the user will replace the golf course green cleaning device 100 on their bag and use as need throughout their round of play. The golf course green cleaning device 100 is periodically engaged with the charger 90 in order to recharge the power source 90 as needed.

Those skilled in the art will recognize that the golf course green cleaning device 100 while intended in its preferred embodiment to remove debris from the predicted putting path of a golf ball on a golf course green should recognize that the golf course green cleaning device 100 could be utilized in numerous different locations to remove debris. While the golf course green cleaning device 100 does not require a specific velocity of air to be produced, good results have been achieve by utilizing a velocity of approximately 350-650 cfm.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A golf course green cleaning device comprising:

a body, said body being generally elongated and cylindrical in shape, said body including a first portion, a second portion and a third portion, said first portion and said third portion having an internal diameter approximately equal, said second portion being intermediate said first portion and said third portion, said second portion having a first end and a second end, said second portion having a diameter proximate said first end approximately equivalent to said first portion, said second portion having a diameter proximate said second end approximately equivalent to said third portion, said second portion having a diameter intermediate said first end and said second end that is greater than that of said first portion and said third portion, said second portion being substantially hollow, said third portion operably connected to said second portion proximate said second end, said third portion further including an internal air passage, said third portion further including an opening, said opening distally located on said third portion from said second portion;

a fan and motor assembly, said fan and motor assembly disposed within said second portion and said first portion, said fan and motor assembly operable to generate an airflow wherein the airflow is directed into said third portion;

a first nozzle, said first nozzle releasably secured to said third portion proximate said opening, said first nozzle being general funnel-shaped, said first nozzle for directing the airflow exiting said opening into a wide angle pattern;

a second nozzle, said second nozzle releasably secured to said third portion proximate said opening in place of said first nozzle, said second nozzle having three extendible members, said second nozzle configured to direct the airflow exiting said opening in a narrow pattern;

a power supply, said power supply configured to be rechargeable, said power supply electrically coupled to said fan and motor assembly, said power supply for supplying power to said fan and motor assembly, said power supply being a lithium ion rechargeable battery;

a trigger, said trigger movably coupled to said first portion of said body, said trigger electrically coupled to said power supply, said trigger operable to close electric circuit between said power supply and said fan and motor assembly so as to allow current to flow to said fan and motor assembly from said power supply;

at least one intake vent, said at least one intake vent disposed on the outer surface of said second portion of said body, said at least one intake vent functioning to permit said fan and motor assembly to draw air into said second portion;

a charging receptacle, said charging receptacle operable to receive said first portion of said body, said charging receptacle operable to supply current to said power supply to replenish the quantity of stored power of said power supply; and wherein the golf course green cleaning device enables a user to displace debris superposed on a golf course green utilizing the airflow exiting said opening of said third portion.

2. A cleaning device configured to remove debris from a predicted putting path of a golf ball superposed on a golf course green comprising:

a body, said body being generally elongated and cylindrical in shape, said body including a first portion, a second portion and a third portion, said first portion and said third portion having an internal diameter approximately equal, said second portion being intermediate said first portion and said third portion, said second portion having a first end and a second end, said second portion having a diameter proximate said first end approximately equivalent to said first portion, said second portion having a diameter proximate said second end approximately equivalent to said third portion, said second portion having a diameter intermediate said first end and said second end that is greater than that of said first portion and said third portion such that said second portion is spherical in shape, said second portion being substantially hollow, said third portion operably connected to said said second portion proximate said second end, said third portion further including an internal air passage, said third portion further including an opening, said opening distally located on said third portion from said second portion;

a fan and motor assembly, said fan and motor assembly disposed within said first portion and said second portion of said body, said fan and motor assembly operable to generate an airflow and direct the airflow into said third portion;

a first nozzle, said first nozzle releasably secured to said third portion proximate said opening, said first nozzle being general funnel-shaped, said first nozzle for directing the airflow exiting said opening into a wide angle pattern in the predicted putting path of a golf ball superposed on a golf course green; and a second nozzle, said second nozzle releasably secured to said third portion proximate said opening in place of said first nozzle, said second nozzle having three extendible members, said second nozzle configured to direct the airflow exiting said opening in a narrow pattern, said nozzle being approximately two feet in length;

a trigger, said trigger movably coupled to said first portion of said body, said trigger electrically coupled to said power supply, said trigger operable to close electric circuit between said power supply and said fan and motor assembly so as to allow current to flow to said fan and motor assembly from said power supply, said trigger surrounded by a trigger guard, said trigger guard integrally formed with said first portion of said housing, said trigger guard including five contiguous segments;

a power supply, said power supply configured to be rechargeable, said power supply electrically coupled to said fan and motor assembly, said power supply for supplying power to said fan and motor assembly, said power supply being a lithium ion rechargeable battery;

a plurality of intake vents, said plurality of intake vents disposed on the outer surface of said second portion of said body, said a plurality of intake vents functioning to permit said fan and motor assembly to draw air into said second portion; and a charging receptacle, said charging receptacle operable to receive said first portion of said body, said charging receptacle operable to supply current to said power supply to replenish the quantity of stored power of said power supply.

3. The cleaning device as recited in claim 2, wherein the cleaning device provides airflow exiting said opening with a velocity range of 350-650 cubic feet per minute onto the predicted putting path of a golf ball superposed on a golf course green.

* * * * *